US009300091B2

(12) United States Patent
Katayanagi

(10) Patent No.: US 9,300,091 B2
(45) Date of Patent: Mar. 29, 2016

(54) CONNECTOR WITH INTERPOSED GROUND PLATE

(71) Applicant: Japan Aviation Electronics Industry, Limited, Tokyo (JP)

(72) Inventor: Masayuki Katayanagi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/596,318

(22) Filed: Jan. 14, 2015

(65) Prior Publication Data

US 2015/0255925 A1 Sep. 10, 2015

(30) Foreign Application Priority Data

Mar. 7, 2014 (JP) ..... 2014-045540

(51) Int. Cl.

| | |
|---|---|
| ***H01R 4/66*** | (2006.01) |
| ***H01R 13/6461*** | (2011.01) |
| ***H01R 12/52*** | (2011.01) |
| ***H01R 24/76*** | (2011.01) |
| ***H01R 13/6585*** | (2011.01) |
| ***H01R 13/6594*** | (2011.01) |

(Continued)

(52) U.S. Cl.

CPC ..... *H01R 13/6461* (2013.01); *H01R 12/523* (2013.01); *H01R 13/6585* (2013.01); *H01R 13/6594* (2013.01); *H01R 24/76* (2013.01); *H01R 12/724* (2013.01); *H01R 24/62* (2013.01); *H01R 2107/00* (2013.01)

(58) Field of Classification Search

CPC ..... H01R 23/688; H01R 13/65807

USPC ..... 439/92, 108, 607.5, 607.6

See application file for complete search history.

(56) References Cited

U.S. PATENT DOCUMENTS 4,710,133 A * 12/1987 Lindeman ..... H01R 23/688 439/101

4,762,500 A 8/1988 Dola et al.

(Continued)

FOREIGN PATENT DOCUMENTS

JP 1989-501982 A 7/1989

JP 1995-014580 U 3/1995

(Continued)

*Primary Examiner* — Vanessa Girardi

(74) *Attorney, Agent, or Firm* — Collard & Roe, P.C.

(57) ABSTRACT

A connector is mateable with a mating connector along a mating direction. The connector comprises a housing, a plurality of first contacts, a plurality of second contacts and a ground plate. The housing has a plate-like portion extending in a predetermined plane which is defined by the mating direction and a pitch direction perpendicular to the mating direction. The plate-like portion has a first principal surface and a second principal surface which is opposite to the first principal surface in a predetermined direction perpendicular to both the mating direction and the pitch direction. The first contacts are held by the housing. The first contacts have first contact portions, respectively. The second contacts are held by the housing. The second contacts have second contact portions, respectively. The ground plate includes a main portion. The main portion is formed with a plurality of openings. Each of the openings pierces the main portion in the predetermined direction and has a closed periphery in the predetermined plane. The main portion is embedded in the plate-like portion by insert molding. The main portion is positioned between the first contact portions and the second contact portions in the predetermine direction.

8 Claims, 7 Drawing Sheets

(51) Int. Cl.

| | |
|---|---|
| *H01R 12/72* | (2011.01) |
| *H01R 24/62* | (2011.01) |
| *H01R 107/00* | (2006.01) |

(56) References Cited

U.S. PATENT DOCUMENTS

| | | | | |
|---|---|---|---|---|
| 5,040,998 | A * | 8/1991 | Suzuki | H01R 12/7082 333/246 |
| 5,057,028 | A * | 10/1991 | Lemke | H01R 23/688 439/101 |
| 5,813,871 | A * | 9/1998 | Grabbe | H01R 23/688 439/108 |
| 6,190,202 | B1 * | 2/2001 | Lai | H01R 9/0518 439/578 |
| 7,438,565 | B2 | 10/2008 | Hamazaki | |
| 8,851,927 | B2 * | 10/2014 | Hsu | H01R 13/6594 439/607.11 |
| 9,136,649 | B2 * | 9/2015 | Shih | H01R 13/658 |
| 2013/0005192 | A1 | 1/2013 | Lim | |

FOREIGN PATENT DOCUMENTS

| | | | |
|---|---|---|---|
| JP | 1998-106684 | A | 4/1998 |
| JP | 3308132 | B | 5/2002 |
| JP | 2007-087877 | A | 4/2007 |
| JP | 2011-146210 | A | 7/2011 |
| JP | 2012-033430 | A | 2/2012 |
| JP | 2013-522857 | A | 6/2013 |

* cited by examiner

CONNECTOR WITH INTERPOSED GROUND PLATE

CROSS REFERENCE TO RELATED APPLICATIONS

An applicant claims priority under 35 U.S.C. §119 of Japanese Patent Application No. JP2014-045540 filed Mar. 7, 2014.

BACKGROUND OF THE INVENTION

This invention relates to a connector which comprises a housing having a plate-like portion.

As shown in FIGS. 13 and 14, a connector 100 of JPA 2012-033430 (Patent Document 1) comprises a housing 101, a plurality of first contacts 102, a plurality of second contacts 103 and a shell 104. The first contacts 102 and the second contacts 103 are held by the housing 101. The housing 101 has a plate-like portion 105. Each of the first contacts 102 has a first contact portion 106. Each of the second contacts 103 has a second contact portion 107. The first contact portion 106 is contactable on a principal surface of the plate-like portion 105. The second contact portion 107 is contactable on another principal surface of the plate-like portion 105. The shell 104 is provided with spring portions 108 which are to be connected with a mating shell (not shown).

In order to realize miniaturization and thinning of the connector, it is necessary to reduce a thickness of the plate-like portion of the housing. However, the reduction of the thickness of the plate-like portion causes a problem that electrical characteristics such as crosstalk characteristics and mechanical strength of the connector cannot be sufficiently secured.

SUMMARY OF THE INVENTION

It is an object of the present invention to provide a connector which comprises a housing having a plate-like portion with reduced thickness and has excellent electrical characteristics such as crosstalk characteristics and mechanical strength.

One aspect of the present invention provides a connector which is mateable with a mating connector along a mating direction. The connector comprises a housing, a plurality of first contacts, a plurality of second contacts and a ground plate. The housing has a plate-like portion extending in a predetermined plane which is defined by the mating direction and a pitch direction perpendicular to the mating direction. The plate-like portion has a first principal surface and a second principal surface which is opposite to the first principal surface in a predetermined direction perpendicular to both the mating direction and the pitch direction. The first contacts are held by the housing. The first contacts have first contact portions, respectively. The first contact portions are arranged in the pitch direction so as to be contactable on the first principal surface. The second contacts are held by the housing. The second contacts have second contact portions, respectively. The second contact portions are arranged in the pitch direction so as to be contactable on the second principal surface. The ground plate includes a main portion. The main portion has a flat plate shape. The main portion is formed with a plurality of openings. Each of the openings pierces the main portion in the predetermined direction and has a closed periphery in the predetermined plane. The main portion is embedded in the plate-like portion by insert molding. The main portion is positioned between the first contact portions and the second contact portions in the predetermine direction.

A part of the plate-like portion close to the first principal surface and a part of the plate-like portion close to the second principal surface are connected with each other in the openings of the main portion.

Since the main portion of the ground plate is positioned between the first contact portions of the first contacts and the second contact portions of the second contacts, crosstalk can be reduced between the first contact portions and the second contact portions.

The main portion of the ground plate is intentionally formed with the openings, and the part of the plate-like portion of the housing close to the first principal surface and the part of the plate-like portion of the housing close to the second principal surface are then connected with each other in the openings. Accordingly, the part of the plate-like portion close to the first principal surface and the part of the plate-like portion close to the second principal surface can be prevented from being separated from the main portion of the ground plate.

An appreciation of the objectives of the present invention and a more complete understanding of its structure may be had by studying the following description of the preferred embodiment and by referring to the accompanying drawings.

Figure 1:
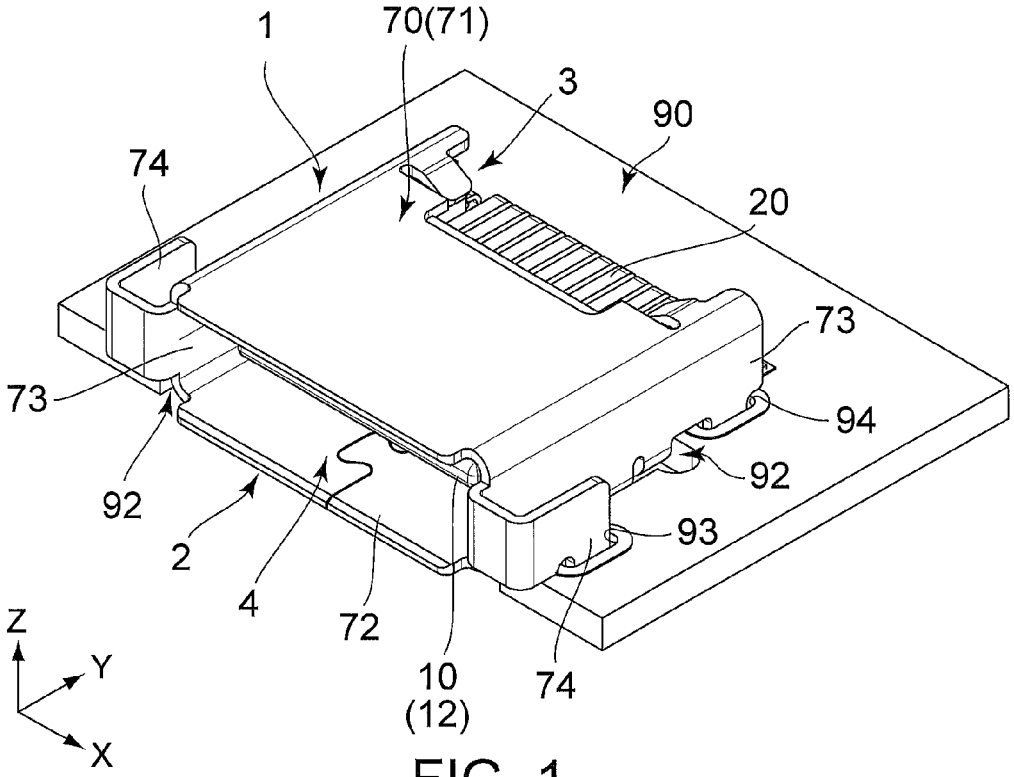
FIG. 1 is an upper perspective view showing a connector according to an embodiment of the present invention. The illustrated connector is mounted on a circuit board (object).

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIG. 1, a connector 1 according to an embodiment of the present invention is mounted and fixed on a circuit board 90 as an object. Specifically, the circuit board 90 is provided with a recess 92 and fixing portions 93, 94. Each of the fixing portions 93, 94 has a through-hole. The recess 92 is recessed inward from an end of the circuit board 90. Almost all of the connector 1 is arranged in the recess 92. In other words, the connector 1 according to the present embodiment is a so-called drop-in connector. However, the present invention is not limited thereto. The connector 1 may be mounted and fixed on a principal surface of the circuit board 90.

Figure 2:
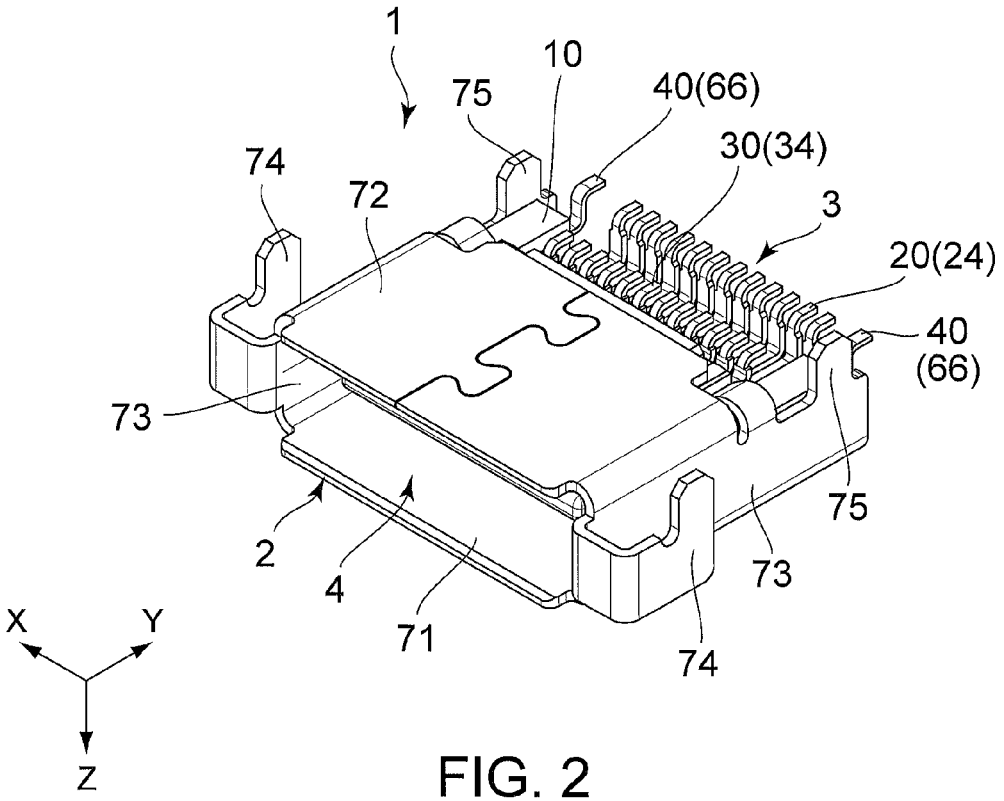
FIG. 2 is a lower perspective view showing the connector of FIG. 1.
Figure 3:
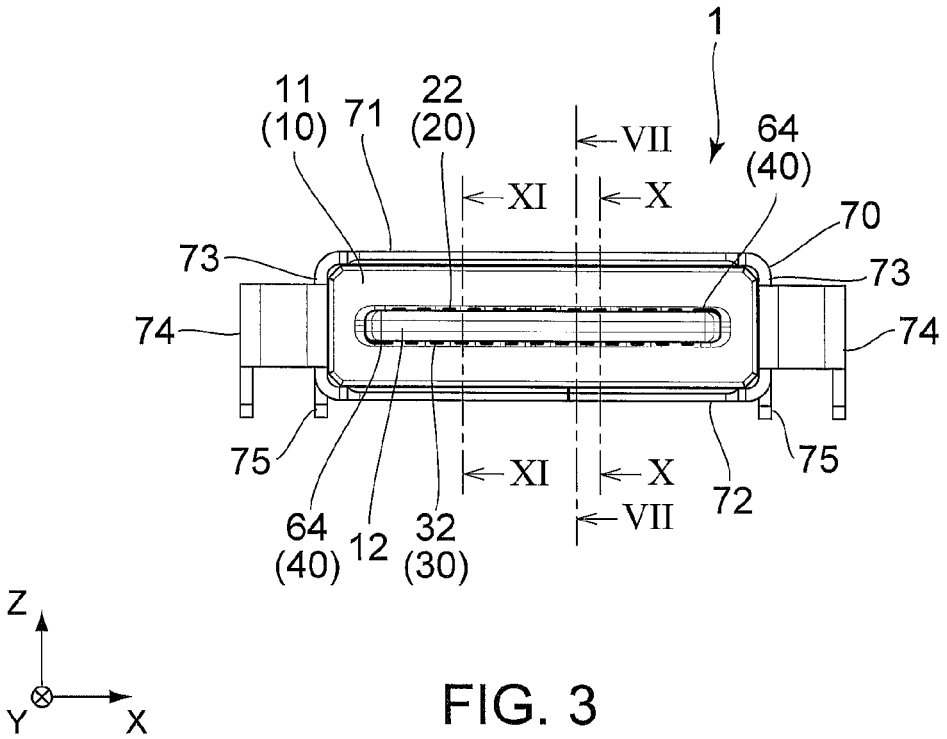
FIG. 3 is a front view showing the connector of FIG. 1.
Figure 4:
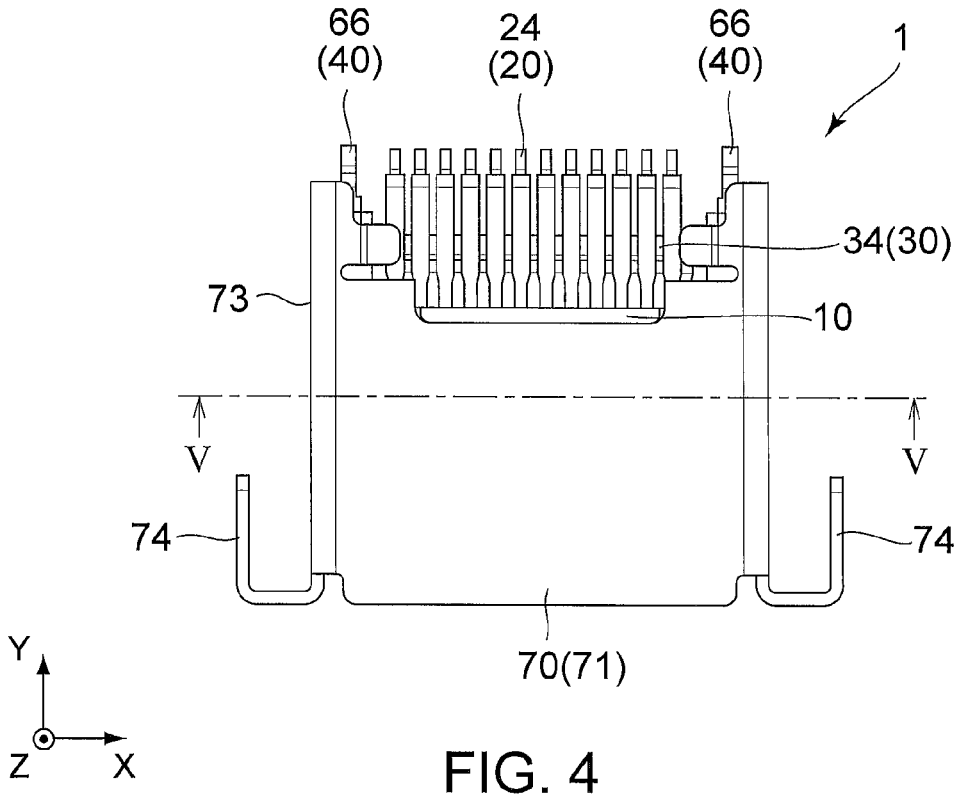
FIG. 4 is a top view showing the connector of FIG. 1.

With reference to FIGS. 1 and 2, the connector 1 is opened at a front end (negative Y-side end) 2 and has a receiving portion 4 extending toward a rear end (positive Y-side end) 3. As understood from FIGS. 7, 10 and 11, the receiving portion 4 of the connector 1 receives a part of a mating connector 80 along a Y-direction (front-rear direction: mating direction). As understood from the above explanation, the connector 1 of the present embodiment is a receptacle, and the mating connector 80 of the present embodiment is a plug.

Figure 10:
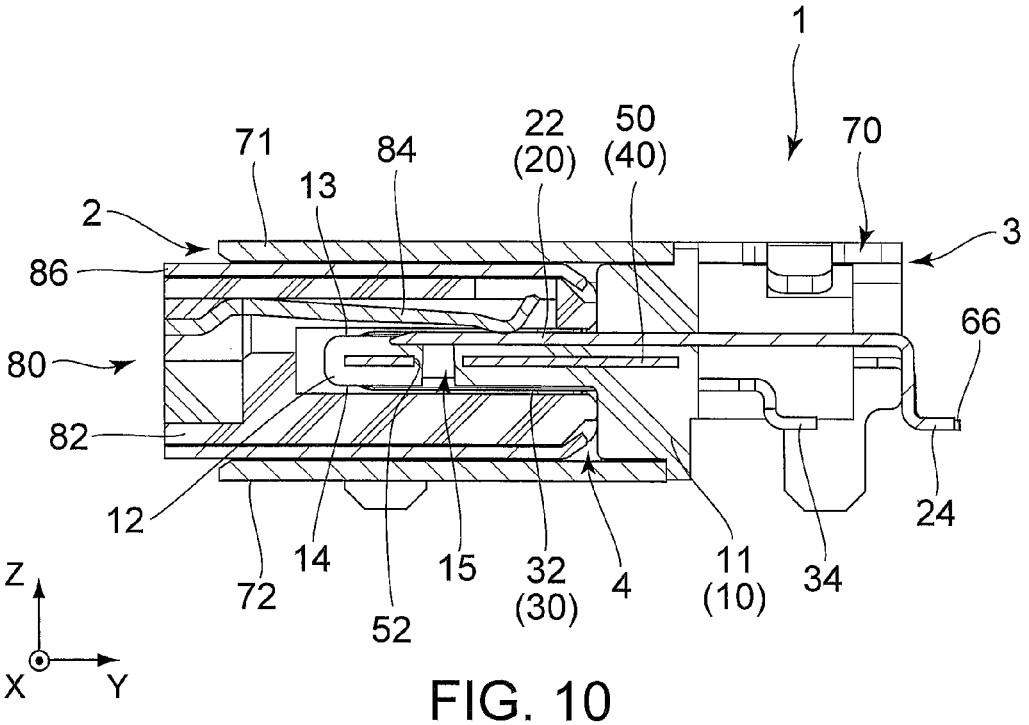
FIG. 10 is a cross-sectional view showing the connector of FIG. 3, taken along line X-X. The illustrated connector is mated with a mating connector.
Figure 11:
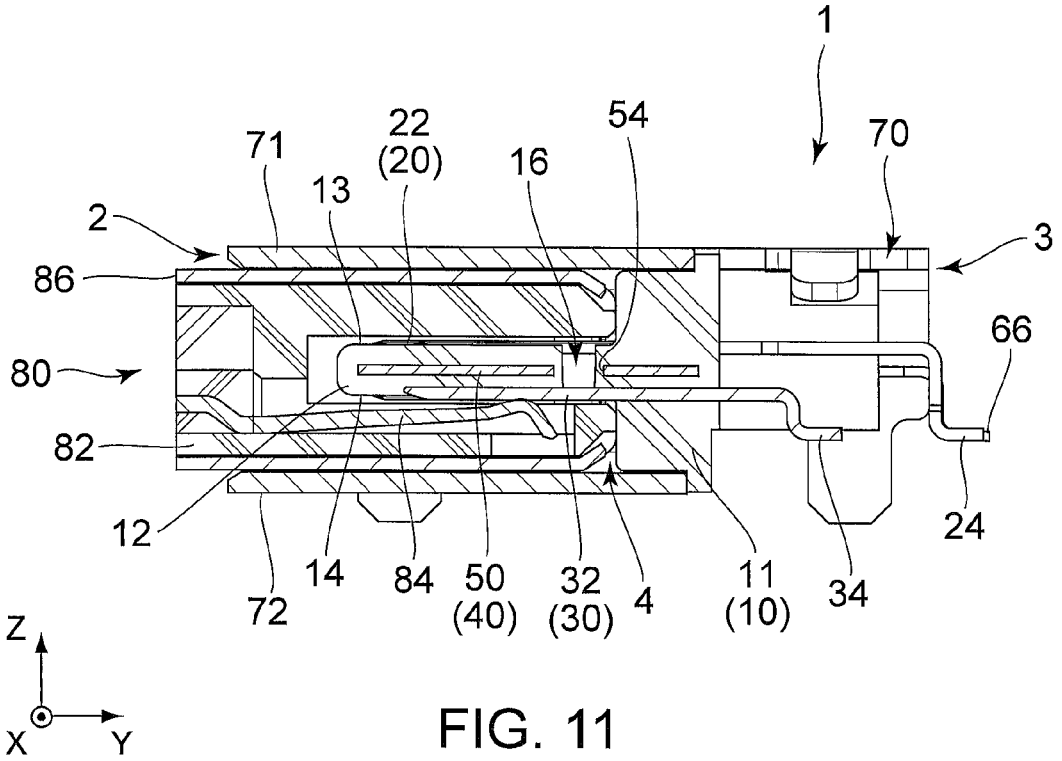
FIG. 11 is a cross-sectional view showing the connector of FIG. 3, taken along line XI-XI. The illustrated connector is mated with a mating connector.

As understood from FIGS. 10 and 11, the mating connector 80 of the present embodiment comprises a mating housing 82, a plurality of first mating contacts 84, a plurality of second mating contacts 84 and a mating shell 86. The mating housing 82 is made of insulator. Each of the first mating contacts 84 is made of conductor. Each of the second mating contacts 84 is made of conductor. The mating shell 86 is made of metal. The first mating contacts 84 and the second mating contacts 84 are held by the mating housing 82. The mating shell 86 at least partly covers the mating housing 82.

With reference to FIGS. 2 to 7, the connector 1 comprises a housing 10, a plurality of first contacts 20, a plurality of second contacts 30, a ground plate 40 and a shell 70. The housing 10 is made of insulator. Each of the first contacts 20 is made of conductor. Each of the second contacts 30 is made of conductor. The ground plate 40 is made of metal. The shell 70 is made of metal.

Figure 7:
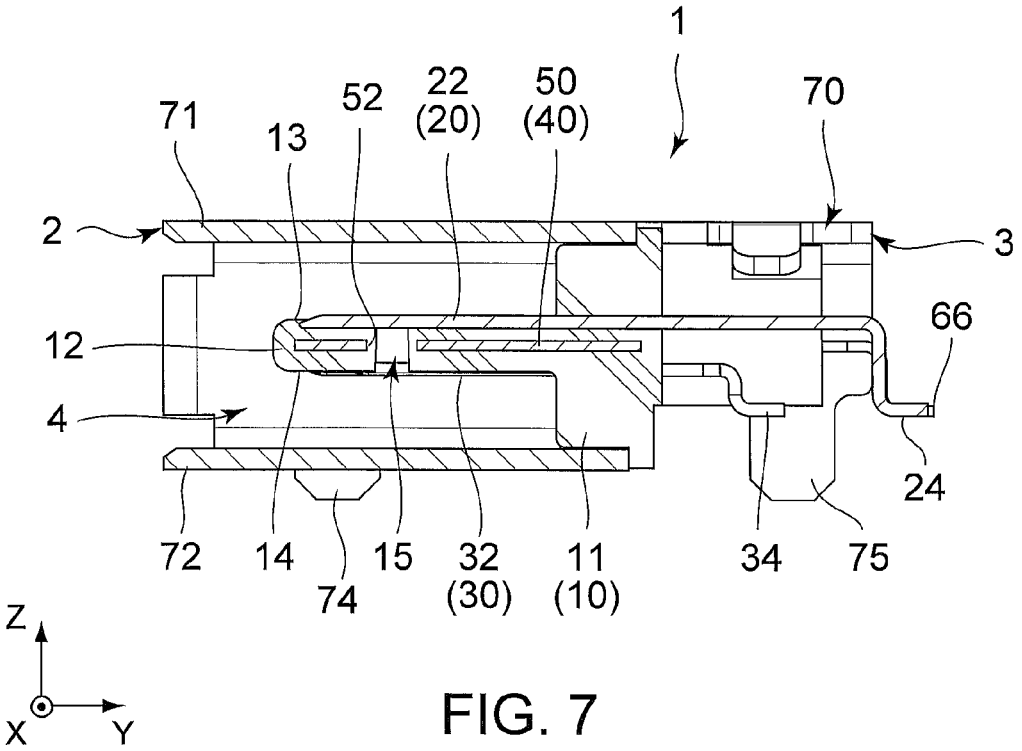
FIG. 7 is a cross-sectional view showing the connector of FIG. 3, taken along line VII-VII.

As understood from FIG. 7, the shell 70 covers almost all of the housing 10. In other words, the shell 70 partly covers the housing 10. As shown in FIGS. 1 and 2, the shell 70 includes an upper surface 71, a lower surface 72 and two side surfaces 73. The shell 70 has a substantially rectangular tube-like shape. The above-mentioned receiving portion 4 is formed by the upper surface 71, the lower surface 72 and the side surfaces 73. The shell 70 is further provided with two front fixed portions 74 and two rear fixed portions 75. The two front fixed portions 74 correspond to the two side surfaces 73, respectively. The two rear fixed portions 75 correspond to the two side surfaces 73, respectively. Each of the front fixed portions 74 first extends outward in an X-direction (pitch direction) from a negative Y-side end of the corresponding side surface 73 (i.e. front end of the corresponding side surface 73), and, then, extend toward a positive Y-direction (rearward) and further toward a negative Z-direction (downward). Since each of the front fixed portions 74 is formed by being folded back at the front end of the corresponding side surface 73, it is not necessary to form an opening on the side surfaces 73 and the lower surface 72 in order to form the front fixed portions 74. Accordingly, all of the side surfaces 73 and the lower surface 72 have no opening. Each of the rear fixed portions 75 extends toward the negative Z-direction (downward) from a vicinity of a positive Y-side end of the corresponding side surface 73 (i.e. rear end of the corresponding side surface 73). As shown in FIG. 1, the front fixed portions 74 are inserted into the fixing portions 93 of the circuit board 90, respectively, and the front fixed portions 74 are then fixed by soldering or the like. Similarly, the rear fixed portions 75 are inserted into the fixing portions 94 of the circuit board 90, respectively, and the rear fixed portions 75 are then fixed by soldering or the like.

As described later, the ground plate 40 of the connector 1 of the present embodiment is connected with mating ground contacts which are included in the first mating contacts 84 and the second mating contacts 84, so that it is not necessary to firmly connect the shell 70 and the mating shell 86. Thus, the shell 70 of the present embodiment does not need to be provided with a spring portion like that of Patent Document 1. Accordingly, the upper surface 71, the lower surface 72 and the side surfaces 73 of the shell 70 are not provided with an opening for formation of the spring portion. In other words, the shell 70 completely separates inside thereof (i.e. receiving portion 4) from outside thereof.

Figure 8:
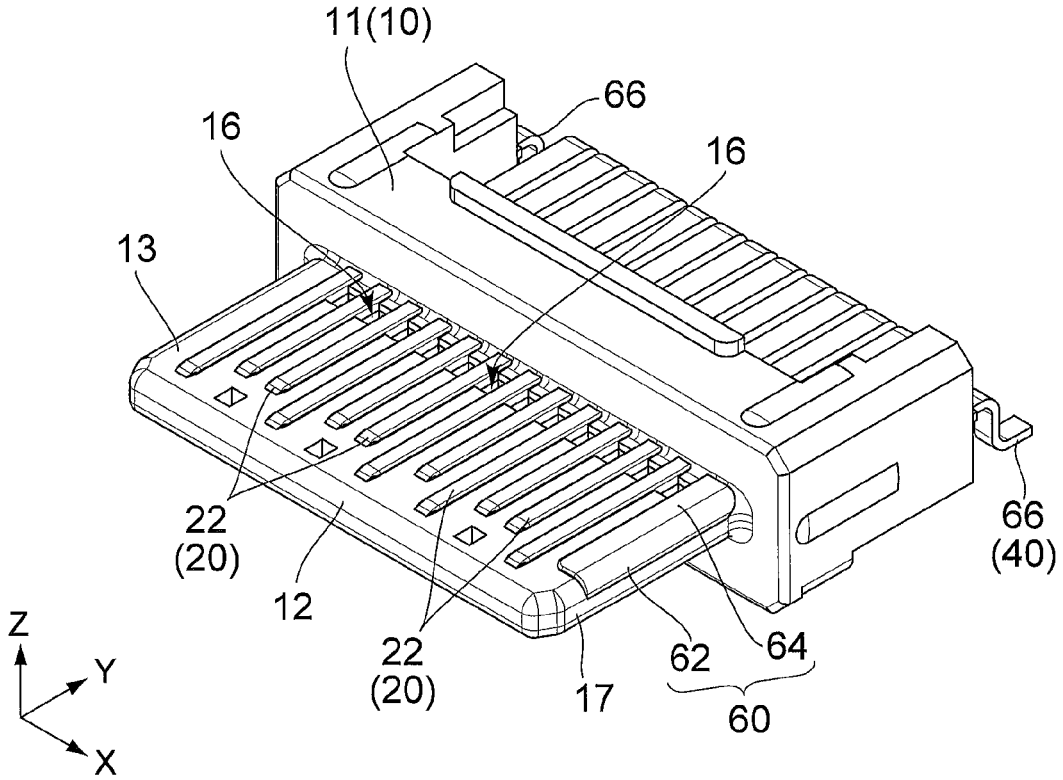
FIG. 8 is an upper perspective view showing components other than a shell among the connector of FIG. 1.
Figure 9:
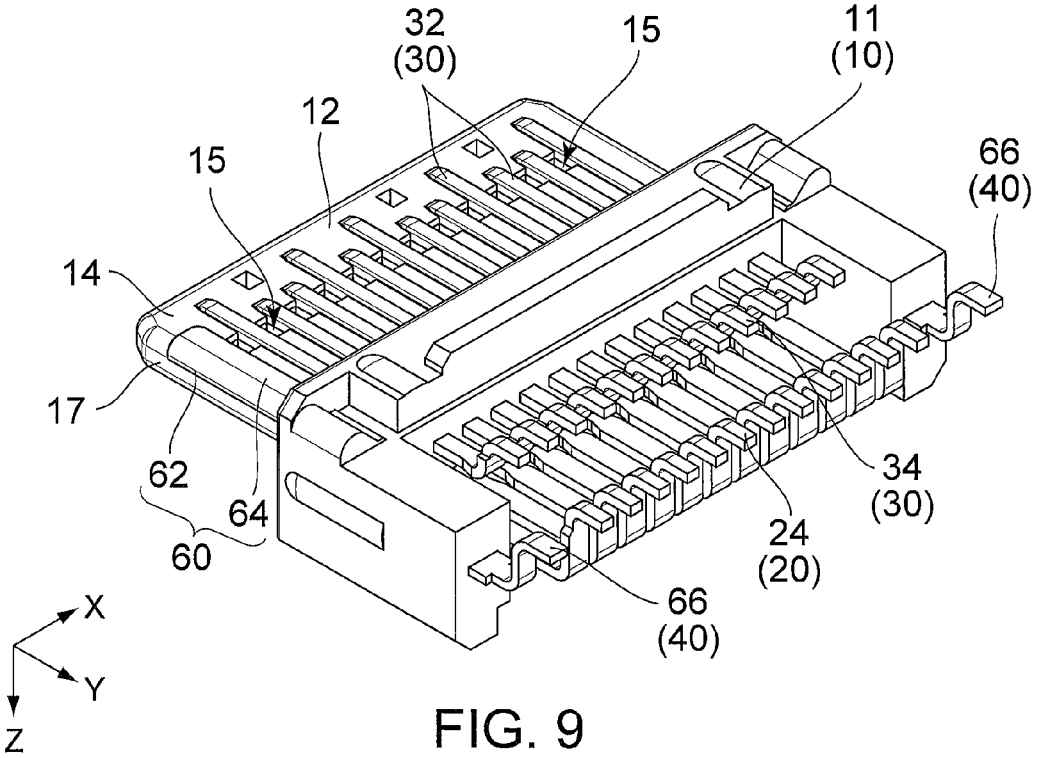
FIG. 9 is a lower perspective view showing the components of FIG. 8.

As shown in FIGS. 8 and 9, the housing 10 has a holding portion 11 and a plate-like portion 12 which projects toward a negative Y-direction (frontward) from the holding portion 11. When the holding portion 11 is seen along the Z-direction (up-down direction: predetermined direction), the holding portion 11 has an angular C-like shape and has a size larger than the plate-like portion 12 in the Z-direction.

As understood from FIGS. 7 to 9, the plate-like portion 12 extends in an XY-plane and has a first principal surface (upper surface) 13 and a second principal surface (lower surface) 14 in the Z-direction. As understood from the above explanation, the second principal surface 14 is opposite to the first principal surface 13. As shown in FIGS. 7, 9 and 10, the second principal surface 14 is formed with first holes 15. In addition, as shown in FIGS. 8 and 11, the first principal surface 13 is formed with second holes 16. Specifically, the plate-like portion 12 is formed with the first holes 15 and the second holes 16 by insert molding. In detail, the first holes 15 extend from the second principal surface 14 to the first contacts 20, respectively, and the second holes 16 extend from the first principal surface 13 to the second contacts 30, respectively. As described later, the first contacts 20, the second contacts 30 and the ground plate 40 are embedded into the housing 10 upon a molding of the housing 10 via insert-molding process. Generally, a molding-die has projecting portions which arrange a metal member in a molding object. When the housing 10 is molded, the projecting portions are brought into contact with the first contacts 20 and the second contacts 30, so that the first contacts 20 and the second contacts 30 are arranged on appropriate positions. Thus, the projecting portions of the molding-die leave the first holes 15 and the second holes 16 into the housing 10, respectively.

As shown in FIGS. 7, 8 and 10, each of the first contacts 20 has a first contact portion 22 and a first fixed portion 24. As shown in FIG. 10, when the connector 1 is mated with the mating connector 80, the first mating contacts 84 are brought into contact with the first contact portions 22 at upper contact positions, respectively. When the connector 1 is mounted on the circuit board 90 as shown in FIG. 1, each of the first fixed portions 24 is fixed on the circuit board 90 by soldering or the like.

The first contacts 20 are partly embedded in the housing 10 by the above-mentioned insert molding. In detail, as understood from FIGS. 7 and 10, the first contacts 20 are partly embedded in the holding portion 11, so that the first contacts 20 are held by the housing 10. The first contact portions 22 are arranged in parallel to each other on the first principal surface 13 of the plate-like portion 12 in the X-direction. The first contact portions 22 are contactable on the first principal surface 13. The first holes 15 are formed by the projecting portions of the molding-die which are used to arrange the first contact portions 22 on the first principal surface 13 upon the above-mentioned insert molding of the housing 10. In addition, each of the first contact portions 22 extends along the Y-direction.

As shown in FIGS. 9 and 11, each of the second contacts 30 has a second contact portion 32 and a second fixed portion 34. As shown in FIG. 11, when the connector 1 is mated with the mating connector 80, the second mating contacts 84 are brought into contact with the second contact portions 32 at lower contact positions, respectively. When the connector 1 is mounted on the circuit board 90 as shown in FIG. 1, each of the second fixed portions 34 is fixed on the circuit board 90 by soldering or the like.

Similar to the first contacts 20, the second contacts 30 are partly embedded in the housing 10 by the above-mentioned insert molding. In detail, as understood from FIG. 11, the second contacts 30 are partly embedded in the holding portion 11, so that the second contacts 30 are held by the housing 10. The second contact portions 32 are arranged in parallel to each other on the second principal surface 14 of the plate-like portion 12 in the X-direction. The second contact portions 32 are contactable on the second principal surface 14. The second holes 16 are formed by the projecting portions of the molding-die which are used to arrange the second contact portions 32 on the second principal surface 14 upon the above-mentioned insert molding of the housing 10. In addition, each of the second contact portions 32 extends along the Y-direction.

As understood from FIGS. 10 and 11, the first holes 15 are positioned toward the negative Y-side (frontward) of the second holes 16. Each of distances between the first holes 15 and the second holes 16 in the Y-direction is larger than a thickness of the plate-like portion 12 (size of the plate-like portion 12 in the Z-direction).

Figure 12:
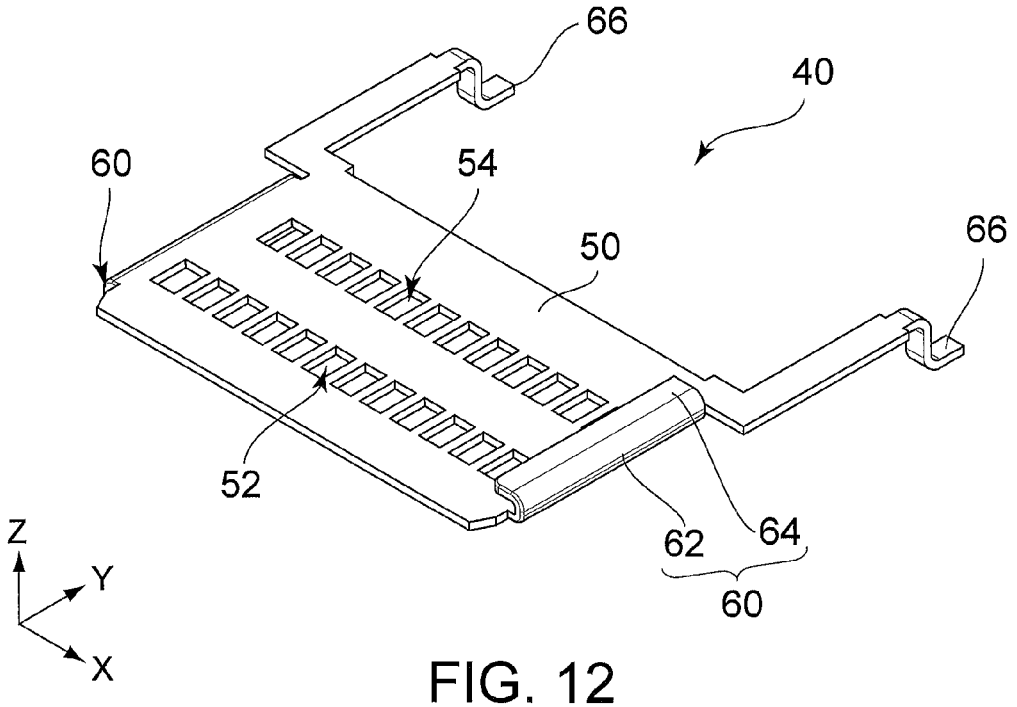
FIG. 12 is a perspective view showing a ground plate which is included in the connector of FIG. 1.
Figure 13:
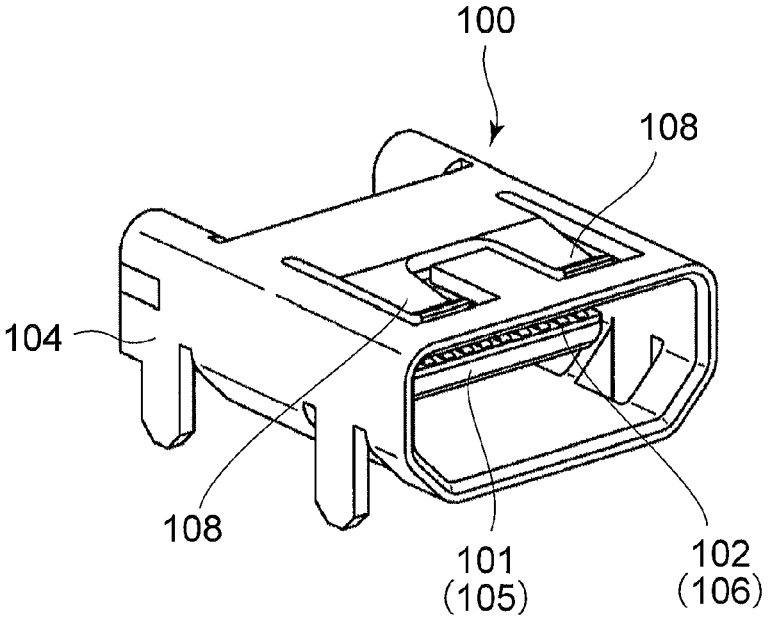
FIG. 13 PRIOR ART
FIG. 13 is a perspective view showing a connector of Patent Document 1.
Figure 14:
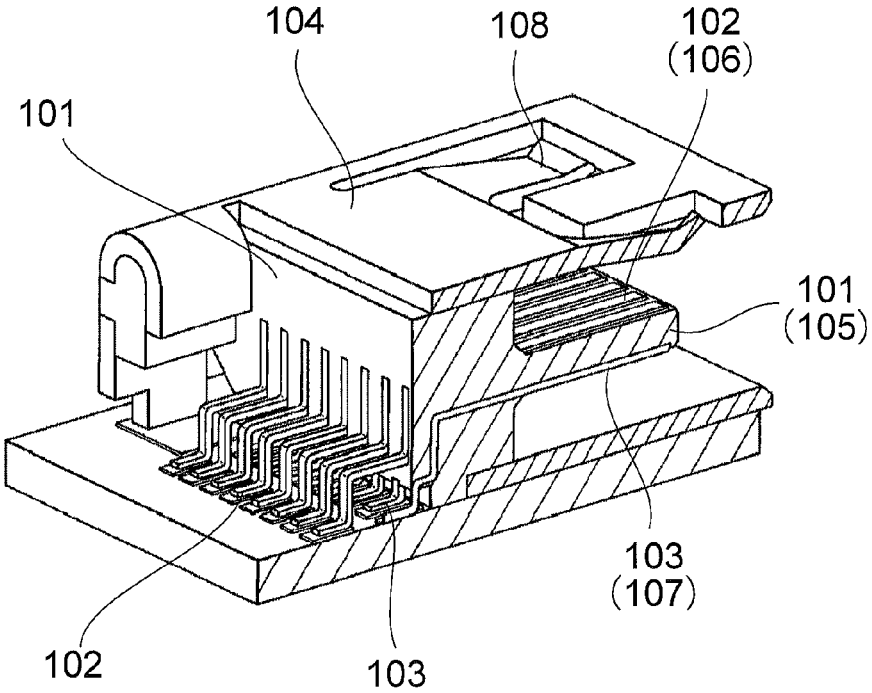
FIG. 14 PRIOR ART
FIG. 14 is a cross-sectional, perspective view showing the connector of FIG. 13.

As shown in FIG. 12, the ground plate 40 has a main portion 50, two reinforcing portions 60 and ground terminals 66. The main portion 50 has a flat plate shape. The main portion 50 is embedded in the plate-like portion 12 by the above-mentioned insert molding. The main portion 50 is positioned between the first contact portions 22 and the second contact portions 32 in the Z-direction.

The main portion 50 is formed with a plurality of openings 52, 54. Each of the openings 52, 54 pierces the main portion 50 in the Z-direction. In detail, the openings 52, 54 include first openings 52 and second openings 54. The first openings 52 are arranged in one row in the X-direction. Similarly, the second openings 54 are arranged in one row in the X-direction. The first openings 52 are positioned toward the negative Y-side (frontward) of the second openings 54. Each of the first openings 52 and the second openings 54 has a closed periphery in the XY-plane. In other words, each of the first openings 52 and the second openings 54 is different from a recess which is recessed inward from an edge of the main portion 50. As shown in FIG. 10, the first openings 52 correspond to the first holes 15 of the plate-like portion 12, respectively. As understood from FIG. 10, each of the first openings 52 has a size larger than the corresponding first hole 15 in the XY-plane. As understood from FIG. 10, in the XY-plane, each of the first holes 15 is positioned in the corresponding first opening 52 and is surrounded by the corresponding first opening 52. As understood from FIG. 11, the second openings 54 correspond to the second holes 16 of the plate-like portion 12, respectively. As understood from FIG. 11, each of the second openings 54 has a size larger than the corresponding second hole 16 in the XY-plane. As understood from FIG. 11, in the XY-plane, each of the second holes 16 is positioned in the corresponding second opening 54 and is surrounded by the corresponding second opening 54. By the formation of the first openings 52 and the second openings 54, a part of the plate-like portion 12 close to the first principal surface 13 (upper part of the plate-like portion 12) and a part of the plate-like portion 12 close to the second principal surface 14 (lower part of the plate-like portion 12) are connected with each other in the first openings 52 and the second openings 54. Accordingly, each of the part of the plate-like portion 12 close to the first principal surface 13 and the part of the plate-like portion 12 close to the second principal surface 14 can be prevented from being separated from the main portion 50. In addition, the first openings 52 of the present embodiment are arranged so as to correspond to the first holes 15, respectively, and the second openings 54 of the present embodiment are arranged so as to correspond to the second holes 16, respectively. Thus, a total area of the first openings 52 and the second openings 54 can be reduced, so that the ground plate 40 can keep a function of reducing crosstalk. Especially, as shown in FIG. 10, the first openings 52 and the second openings 54 are not provided right under upper contact points where the first mating contacts 84 are brought into contact with the first contact portions 22 of the first contacts 20, respectively, and the main portion 50 of the ground plate 40 is positioned right under the upper contact points. Similarly, as shown in FIG. 11, the first openings 52 and the second openings 54 are not provided right under lower contact points where the second mating contacts 84 are brought into contact with the second contact portions 32 of the second contacts 30, respectively, and the main portion 50 of the ground plate 40 is positioned right under the lower contact points. In other words, each of the upper contact positions is different from all of the first openings 52 and the second openings 54 in the XY-plane, and each of the lower contact positions is different from positions of all of the first openings 52 and the second openings 54 in the XY-plane. The ground plate 40 is interposed between the upper contact points and the lower contact points. Accordingly, a mutual electrical effect is reduced between the upper contact points and the lower contact points.

Figure 5:
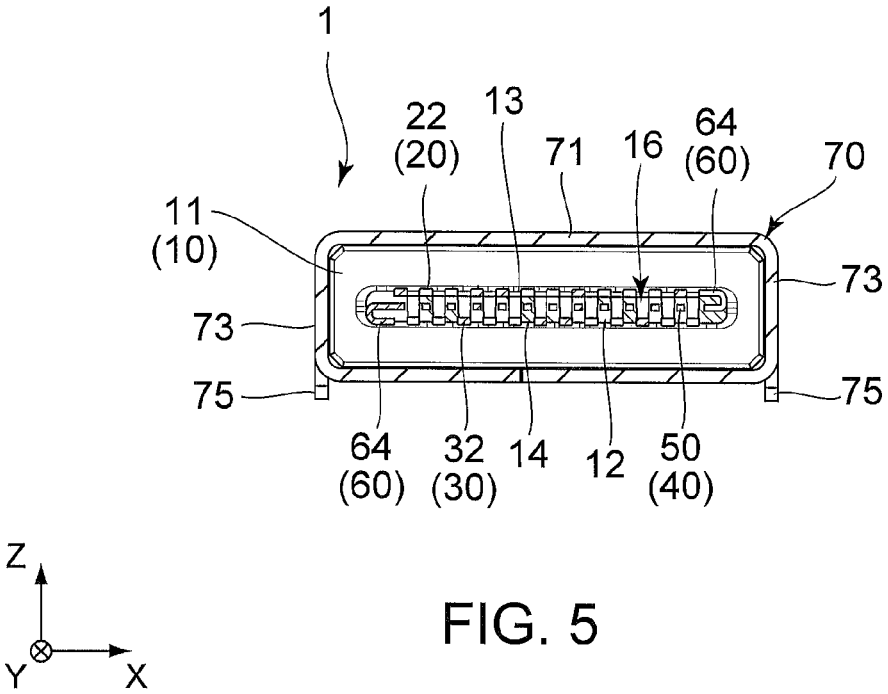
FIG. 5 is a cross-sectional view showing the connector of FIG. 4, taken along line V-V.
Figure 6:
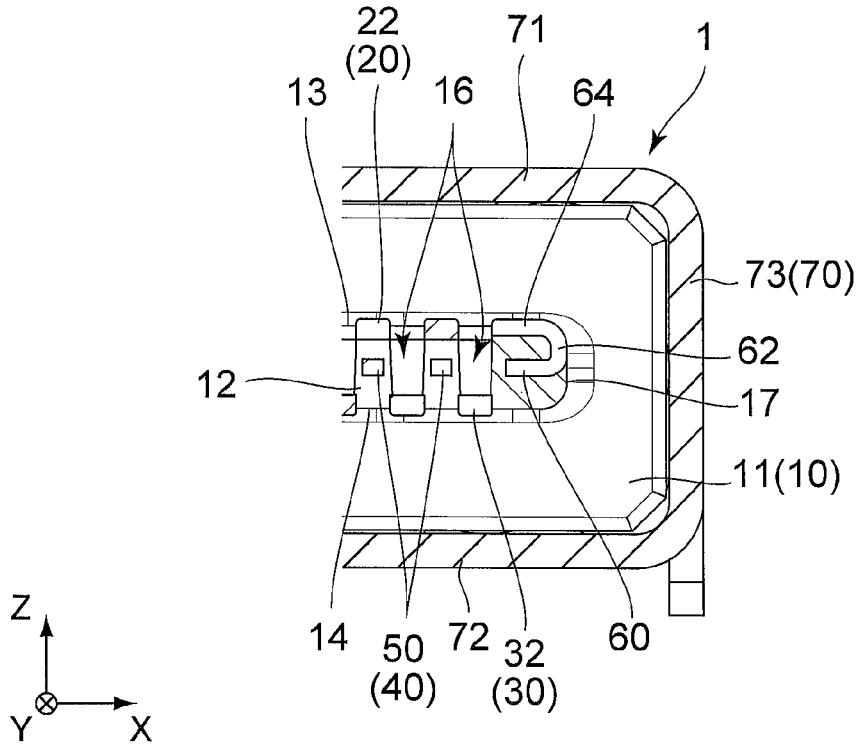
FIG. 6 is an enlarged view showing a part of the connector of FIG. 5.

As understood from FIGS. 5, 6 and 12, the reinforcing portions 60 extend from opposite ends of the main portion 50 in the X-direction, respectively. As shown in FIGS. 5 and 6, each of the reinforcing portions 60 has a C-shaped cross-section in an XZ-plane. As understood from FIG. 12, each of the reinforcing portions 60 extends along the Y-direction. Since the plate-like portion 12 is inserted into the reinforcing portions 60 upon the above-described insert molding of the housing 10, the plate-like portion 12 is reinforced by the reinforcing portions 60 and is hardly separated from the main portion 50 of the ground plate 40. Especially, as shown in FIG. 5, the two reinforcing portions 60 of the present embodiment extend toward orientations different from each other in the Z-direction as viewed from the main portion 50. Specifically, a positive X-side reinforcing portion 60 is positioned close to the first principal surface 13, and a negative X-side reinforcing portion 60 is positioned close to the second principal surface 14. Thus, the part of the plate-like portion 12 close to the first principal surface 13 and the part of the plate-like portion 12 close to the second principal surface 14 are reinforced by the reinforcing portions 60.

More particularly, as shown in FIG. 6, each of the reinforcing portions 60 includes a guard portion 62 and a ground contact portion 64.

As understood from FIGS. 6, 8 and 9, each of the guard portions 62 is exposed on the plate-like portion 12 in the X-direction. Especially, the guard portions 62 are partly exposed on the side surfaces 17, respectively. If the mating connector 80 (see FIGS. 10 and 11) is inserted obliquely with respect to the XY-plane into the connector 1, the guard portions 62 can receive the mating shell 86 (see FIGS. 10 and 11). Accordingly, the plate-like portion 12 can be prevented from being scratched.

As understood from FIGS. 6, 8 and 9, one of the two ground contact portions 64 is exposed on the first principal surface 13 of the plate-like portion 12, and a remaining one of the two ground contact portions 64 is exposed on the second principal surface 14 of the plate-like portion 12. The ground contact portions 64 are portions which are brought into contact with the mating ground contacts, respectively. The ground plate 40, which is connected with the mating ground contacts at the ground contact portions 64, is connected through the ground terminals 66 to ground portion (not shown) on the circuit board 90 (see FIG. 1). Accordingly, strong connection between the ground plate 40 and ground can be established. As described above, the shell 70 and the mating shell 86 may not be directly connected with each other. Since the shell 70 does not need to be provided with a spring portion which is to be connected with the mating shell 86, the shell 70 is not formed with an extra opening. As understood from FIGS. 1, 2 and 7, the shell 70 except a joint thereof perfectly surrounds the plate-like portion 12 of the housing 10, the first contact portion 22 of the first contacts 20 and the second contact portions 32 of the second contacts 30 in the XZ-plane. Specifically, the shell 70 except the joint thereof surrounds the plate-like portion 12 of the housing 10, the first contact portions 22 of the first contacts 20 and the second contact portions 32 of the second contacts 30 in a direction perpendicular to the Y-direction. Thus, the connector 1 of the present embodiment has a high resistance to EMI (Electro-Magnetic Interference).

Especially, as shown in FIGS. 5 and 6, one of the ground contact portions 64 is positioned at a position same as a position of the first contact portion 22 of the first contact 20 in the Z-direction, and a remaining one of the ground contact portions 64 is positioned at a position same as a position of the second contact portion 32 of the second contact 30 in the Z-direction. Accordingly, each of the mating ground contacts among the first mating contacts 84 and the second mating contacts 84 (see FIGS. 10 and 11) can have a shape same as a shape of one of remaining first mating contacts 84 and remaining second mating contacts 84. Since it is not necessary to specially prepare the mating ground contacts, an unnecessary increase of manufacturing cost can be avoided in a case where ground connections of the present invention is employed.

While the present invention has been described with specific embodiments, the present invention is not limited to the aforementioned embodiments. Various modifications and applications are possible with the present invention. Although the first fixed portions 24 of the first contacts 20, the second fixed portions 34 of the second contacts 30 and the ground terminals 66 of the present embodiment are for surface mount technology (SMT), for example, the first fixed portions 24, the second fixed portions 34 and the ground terminals 66 may be for through-hole technology (THT).

Although the first contacts 20 and the second contacts 30 of the above-described embodiment are partly embedded into the housing 10 by the insert molding, the present invention is not limited thereto. For example, the first contacts 20 and the second contacts 30 may be embedded in the housing 10 by any other means. In that case, the first holes 15 and the second holes 16 are not formed, and the first openings 52 and the second openings 54 are formed irrespective of the first holes 15 and the second holes 16.

When the first contacts 20 and the second contacts 30 are partly embedded in the housing 10 by the insert molding as described above, the first holes 15 and the second holes 16 may be formed so as to be positioned apart from the first openings 52 and the second openings 54. However, in that case, the main portion 50 of the ground plate 40 is formed with openings which correspond to the first holes 15 and the second holes 16, respectively, so that a total area of the openings which are formed on the main portion 50 of the ground plate 40 is increased. Thus, it is preferable to arrange the first openings 52 and the second openings 54 so as to be associated with the first holes 15 and the second holes 16, respectively, as in the above-described embodiment.

In the above-described embodiment, the first openings 52 and the second openings 54 are provided so as to correspond to the first holes 15 and the second holes 16 in a one-to-one relationship. The present invention is not limited thereto. For example, one of the first openings 52 may be arranged so as to correspond to the first holes 15, and one of the second openings 54 may be arranged so as to correspond to the second holes 16. However, in that case, a total area of openings which are formed on the main portion 50 is increased. Thus, it is preferable to arrange the first openings 52 and the second openings 54 so as to be associated with the first holes 15 and the second holes 16, respectively, as in the above-described embodiment.

The present application is based on a Japanese patent application of JP2014-045540 filed before the Japan Patent Office on Mar. 7, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a mating direction, the connector comprising:

a housing having a plate-like portion extending in a predetermined plane which is defined by the mating direction and a pitch direction perpendicular to the mating direction, the plate-like portion having a first principal surface and a second principal surface which is opposite to the first principal surface in a predetermined direction perpendicular to both the mating direction and the pitch direction;

a plurality of first contacts which are held by the housing, the first contacts having first contact portions, respectively, the first contact portions being arranged in the pitch direction so as to be contactable on the first principal surface;

a plurality of second contacts which are held by the housing, the second contacts having second contact portions, respectively, the second contact portions being arranged in the pitch direction so as to be contactable on the second principal surface; and a ground plate including a main portion, the main portion having a flat plate shape, the main portion being formed with a plurality of openings, each of the openings piercing the main portion in the predetermined direction and having a closed periphery in the predetermined plane, the main portion being embedded in the plate-like portion by insert molding, the main portion being positioned between the first contact portions and the second contact portions in the predetermine direction, a part of the plate-like portion close to the first principal surface and a part of the plate-like portion close to the second principal surface being connected with each other in the openings of the main portion.

2. The connector as recited in claim 1, wherein:

the first contacts and the second contacts are, at least in part, embedded in the housing by the insert molding;

the plate-like portion is formed with first holes and second holes upon the insert molding, the first holes extending from the second principal surface to the first contacts, respectively, the second holes extending from the first principal surface to the second contacts, respectively;

the openings include first openings and second openings;

the first holes are positioned in the first openings, respectively, in the predetermined plane; and the second holes are positioned in the second openings, respectively, in the predetermined plane.

3. The connector as recited in claim 1, wherein:

the mating connector comprises a plurality of first mating contacts and a plurality of second mating contacts;

the first mating contacts are brought into contact with the first contact portions at upper contact positions, respectively;

each of the upper contact positions is different from positions of all of the openings in the predetermined plane;

the second mating contacts are brought into contact with the second contact portions at lower contact positions, respectively; and each of the lower contact positions is different from positions of all of the openings in the predetermined plane.

4. The connector as recited in claim 1, wherein:

the ground plate further includes two reinforcing portions which extend from opposite ends of the main portion in the pitch direction, respectively; and each of the reinforcing portions has a C-shaped cross-section in a plane which is defined by the predetermined direction and the pitch direction.

5. The connector as recited in claim 4, wherein, as viewed from the main portion, the reinforcing portions extend toward orientations different from each other in the predetermined direction.

6. The connector as recited in claim 4, wherein each of the reinforcing portions includes a guard portion which is exposed on the plate-like portion in the pitch direction.

7. The connector as recited in claim 4, wherein:

the connector is mounted on an object when used;

each of the reinforcing portions includes a ground contact portion which is exposed on the first principal surface or the second principal surface; and the ground plate further includes a ground terminal which is to be connected to the object.

8. The connector as recited in claim 7, wherein each of the ground contact portions is positioned at a position same as a position of the first contact portion or a position of the second contact portion in the predetermined direction.

* * * * *